United States Patent [19]

Ateya et al.

[11] 4,232,959

[45] Nov. 11, 1980

[54] TONER IMAGE FUSING APPARATUS

[75] Inventors: Antoun I. Ateya; Walter A. Stryjewski, both of Rochester, N.Y.

[73] Assignee: Eastman Kodak Company, Rochester, N.Y.

[21] Appl. No.: 939,556

[22] Filed: Sep. 5, 1978

[51] Int. Cl.[3] ..... G03G 15/00

[52] U.S. Cl. ..... 355/3 FU; 219/216; 355/14 FU; 430/97; 432/60

[58] Field of Search ..... 355/3 R, 3 FU, 14 FU; 219/216; 432/60; 430/97, 98, 99

[56] References Cited

U.S. PATENT DOCUMENTS

| | | | |
|---|---|---|---|
| 3,666,247 | 5/1972 | Banks | 355/3 FU X |
| 3,690,176 | 9/1972 | Connolly et al. | 355/3 FU X |
| 4,162,847 | 7/1979 | Brandon | 355/3 FU X |

*Primary Examiner*—Fred L. Braun

*Attorney, Agent, or Firm*—William F. Noval

[57] ABSTRACT

Apparatus for fusing a toner image carried by a support. The apparatus includes first and second members, at least one of which is heated, which are supported in variable pressure engagement to fuse a toner image carried by a support passed between the members. A sensor senses the temperature of the heated member(s) and the pressure of engagement force is varied as a function of the temperature in order to maintain consistent fused image quality.

8 Claims, 6 Drawing Figures

FIG. 1
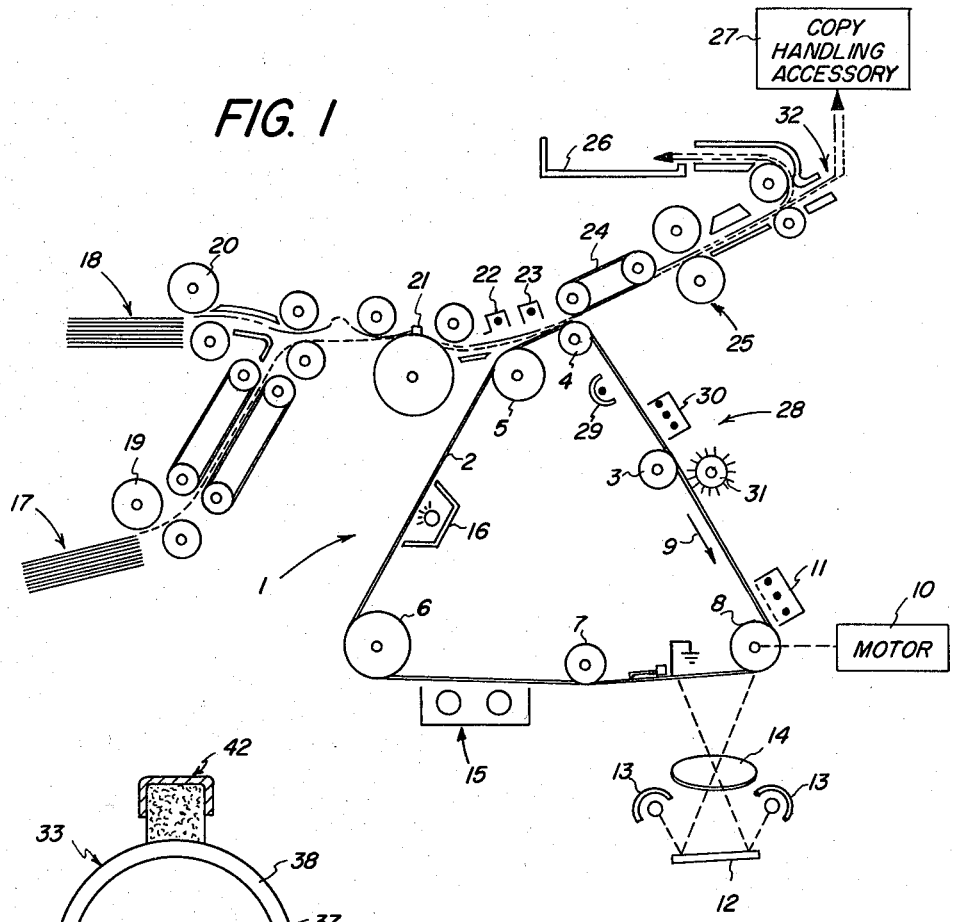
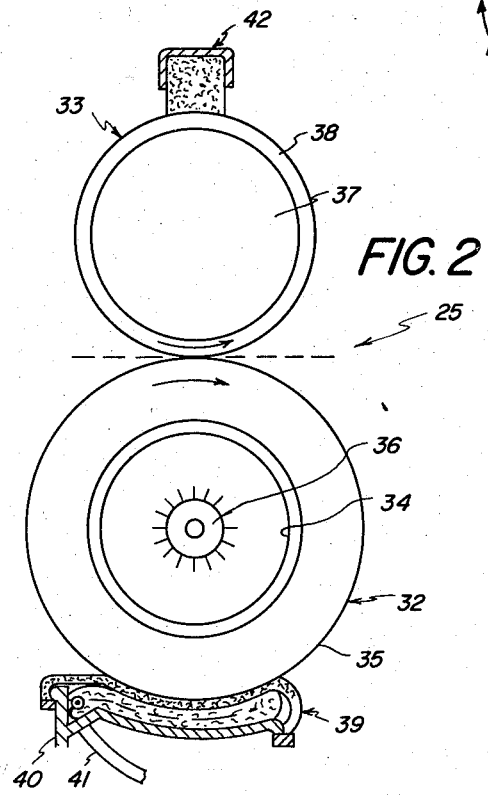
FIG. 2
FIG. 6
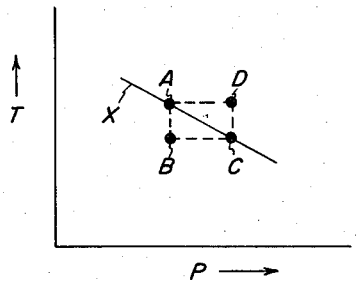

TONER IMAGE FUSING APPARATUS

BACKGROUND OF THE INVENTION

1. Field of the Invention

This invention relates to apparatus for fusing toner images to a support by means of heat and pressure and more particularly to fusing apparatus for maintaining uniform fusing quality by varying the fusing pressure as a function of variations in fusing temperature.

2. Description of the Prior Art

In a known type of electrographic reproduction apparatus, a copy of an original is produced by uniformly charging a photoconductive member and exposing it to a light image of the original to form a latent electrostatic image corresponding to the original. The latent image is developed into a visible image through the application of charged toner particles. The toner image is then transferred to a support such as a copy sheet which ultimately becomes the final copy of the original. Typically the toner particles are fused to the copy sheet by advancing the sheet through the nip of a pair of rollers at least one of which is heated. These rollers serve to fuse the toner particles to the copy sheet through the application of a combination of heat and pressure.

In order to increase their life, fuser rollers are typically engaged only during a copy run and disengaged when copy sheets are not being processed. Although the degree of pressure engagement between the fuser rollers may be manually adjustable, once a desired pressure has been selected, the pressure will be maintained constant during each copy run until such time as a new pressure is manually selected. Commonly, the temperature at the surface of the heated roller is maintained within a preselected operating range which is consistant with the selected pressure in order to effect proper fusing of toner images to copy sheets.

It has been found that in long copy runs the amount of heat lost to the copy sheets causes a drop in the amount of heat supplied to the toner images of successive copy sheets resulting in a drop in fusing quality to undesirable levels. Control of fusing temperature alone is not completely satisfactory, since there is an unavoidable delay between the time a change of temperature is sensed and the time the heated roller can be brought to a new temperature.

SUMMARY OF THE INVENTION

According to the present invention, toner image fusing apparatus is provided wherein quality of fused images on a support is maintained by varying the pressure between two fusing members, at least one of which is heated, as a function of the temperature of the fusing apparatus. According to an aspect of the invention, the fusing members are supported in variable pressure engagement and at least one of the members is heated so that when a support carrying a toner image is passed between the members, the toner image is fused to the support by a combination of heat and pressure. A temperature sensing device is provided to sense the temperature of the heated member and as the temperature sensed varies, the pressure of engagement force of the members is varied to maintain constant fusing conditions.

According to another aspect of the invention the fusing apparatus includes a pair of rollers forming a nip, either one or both of which are heated. The rollers are mounted for variable pressure engagement in response to changes in temperature of the fusing rollers.

BRIEF DESCRIPTION OF THE DRAWINGS

In the detailed description of the preferred embodiment of the invention presented below reference is made to the accompanying drawings, in which:

FIG. 1 is a schematic view of apparatus incorporating a preferred embodiment of toner image fusing apparatus of the present invention;

FIG. 2 is a schematic view of the fusing apparatus of FIG. 1;

FIG. 6 is a graph showing the relationship between temperature and pressure in order to maintain proper fusing quality.

DESCRIPTION OF THE PREFERRED EMBODIMENT

Figure 3:
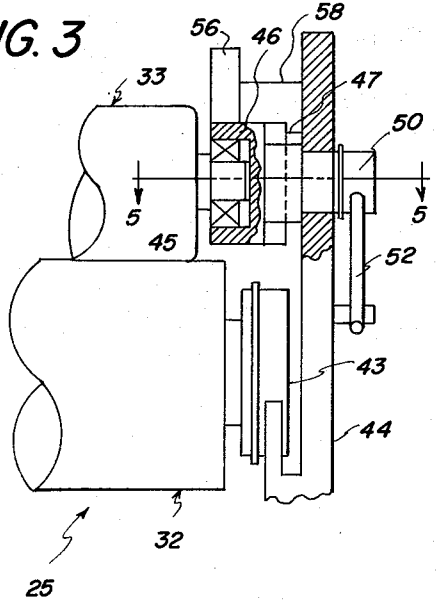
FIG. 3 is a front elevational partially sectional view of one end of the fusing apparatus of FIG. 2.

Referring now to the drawings, there is disclosed electrophotographic apparatus incorporating a preferred embodiment of the present invention. It is to be understood, however, that the apparatus of the present invention could be used with equal facility and advantage in other types of reproduction apparatus and therefore, that the following description of apparatus related to but not forming part of the invention is provided for illustrative purposes only.

ELECTROPHOTOGRAPHIC APPARATUS

Referring to FIG. 1, there is shown electrophotographic apparatus 1 including a photoconductive member 2, trained about rollers 3–8, which is moved in the direction of arrow 9, past various electrophotographic work stations by means of motor 10 coupled to roller 8. For the purpose of the instant discussion the several work stations along, the path of movement of member 2 are as follows. A uniform electrostatic negative charge is placed on member 2 by corona charger 11 which may for example be a three wire grid controlled type. An original document 12 bearing an image to be reproduced is irradiated by flash lamps 13, the reflected radiation image is projected onto photoconductive member 2 by lens 14 to selectively dissipate charge on member 2 and form a latent electrostatic image corresponding to the original image.

A development station 15 includes a magnetic brush developer which brushes developer including positively charged toner particles over member 2. The toner particles adhere to the latent electrostatic image to form a visible toner image which corresponds to the original image. Post development erase station 16 includes an infrared illumination source to reduce photoconductor fatigue and to facilitate subsequent toner image transfer.

Copy sheets of any suitable material such as paper, transparencies or the like are supplied from the top of either of supplies 17 or 18 by means of oscillating vacuum rollers 19 and 20, respectively, to a registration mechanism 21. Mechanism 21 registers a copy sheet with a toner image on a web 2 at transfer station 22 which includes a negatively charged corona charger. The corona charger applies negative charge to the back of the copy sheet to bring the copy sheet into contact with member 2 and to transfer the toner image from member 2 onto the copy sheet. Detack charger 23 neutralizes the charge on the copy sheet so that it can be easily separated from member 2.

As a copy sheet separates from member 2 at roller 4, vacuum transport 24 conveys it to fuser 25 (to be described in greater detail below) which fuses the toner image to the copy sheet by means of heat and pressure. The copy sheet is then transported to an output tray 26 or to a copy handling accessory 27 such as a sorter.

A cleaning station 28 is provided to effect mechanical and electrical cleaning of photoconductive member 2. Station 28 includes a cleaning assist erase lamp 29 which exposes the photoconductor to radiation to reduce more of the charge remaining from the transfer and detack steps; a cleaning assist charger 30 which impresses an AC charge on member 2 to neutralize the charges on untransferred toner particles; and a brush 31 which removes any residual toner from member 2 and deposits it in a suitable collection container (not shown).

TONER IMAGE FUSING APPARATUS

Referring now to FIGS. 2–5 there is shown an embodiment of toner image fusing apparatus according to the present invention. As shown in FIG. 2, fusing apparatus 25 includes a heated roller 32 and a pressure roller 33. Roller 32 includes a cylindrical metallic core 34 covered with a layer 35 of compliant material such as silicone rubber. A source of heat such as quartz lamp 36 is centered within core 34 and provides heat to heat the outer surface of cover 35 which comes into fusing contact with a toner image on a copy sheet passed between rollers 32 and 33. Pressure roller 33 includes a metallic core 37 and an outer cover 38 of heat resistant, toner offset preventing material such as polytetrafluoroethylene. Toner offset preventing liquid is applied to cover 35 by means of a wick 39 of porous material mounted on frame 40 and supplied with toner offset preventing liquid by means of tube 41 from a suitable supply (not shown). A wiper 42 contacts roller 33 to remove any liquid or other debris which may accumulate on roller 33.

Figure 5:
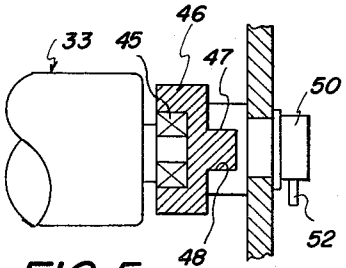
FIG. 5 is a top elevational view, partly in section of a portion of the fusing apparatus taken along lines 5—5 of FIG. 3.

Roller 32 is shown (FIG. 3) provided with bearings 43 which are supported in a V-shaped portion of frame 44 of copier 1. Roller 33 is supported by bearings 45 carried in end caps 46. Each of end caps 46 has an integral tongue 47 which fits slidably into a slot 48 in a guide 50 (FIG. 5). The respective guides 50 are rotatably mounted in the frame 44. When the guides 50 are positioned with their slot 48 in a vertical orientation, the roller 33 is constrained to move only in a vertical direction for application of pressure during machine operation. When the slot is oriented in a horizontal direction, the roller 33 is constrained to move only in a horizontal direction which enables the roller to be easily removed for service. An arm 52 is fixed to each guide 50 for manually selecting the position thereof and a spring detent 54 (FIG. 4) maintains the guide in the selected position.

Fusing of toner images to a copy sheet is effected by the selection of a proper combination of pressure and heat. In known electrographic apparatus, pressure roller engagement force is held constant during a copy run while the temperature of the heated image contacting fuser roller(s) is varied within a predetermined temperature range by means of a sensor which senses the fuser roller(s) temperature and provides an input signal to a temperature controller which regulates the heat energy supplied to the heated roller(s).

Although such a temperature feedback system may be satisfactory for either short or long copy runs, a drawback lies in its inability to overcome the thermal inertia of the mass of the heated fuser roller whose core temperature must rise before its copy-cooled cover returns to the required temperature. Consequently, during the period that the roller's cover surface temperature is below the satisfactory minimum fusing temperature, the fusing quality of the processed documents is not at the desired level. This result can be overcome by the addition of increased roller engagement force which compensates for the effects of reduced roller surface temperature by applying greater-than-normal unit nip pressure and somewhat extended nip times. The extended nip times result from the increased roller interferences created by the higher roller engagement forces. Proper combinations of increased roller engagement force and roller temperatures can be determined by empirical techniques for the materials and configurations used so that transient roller temperature decreases do not materially impact the fusing quality of sequentially processed copies. According to the present invention, fused image quality is maintained by varying the pressure of engagement of the fuser rollers as a function of the variation in temperature of the heated roller(s).

Figure 4:
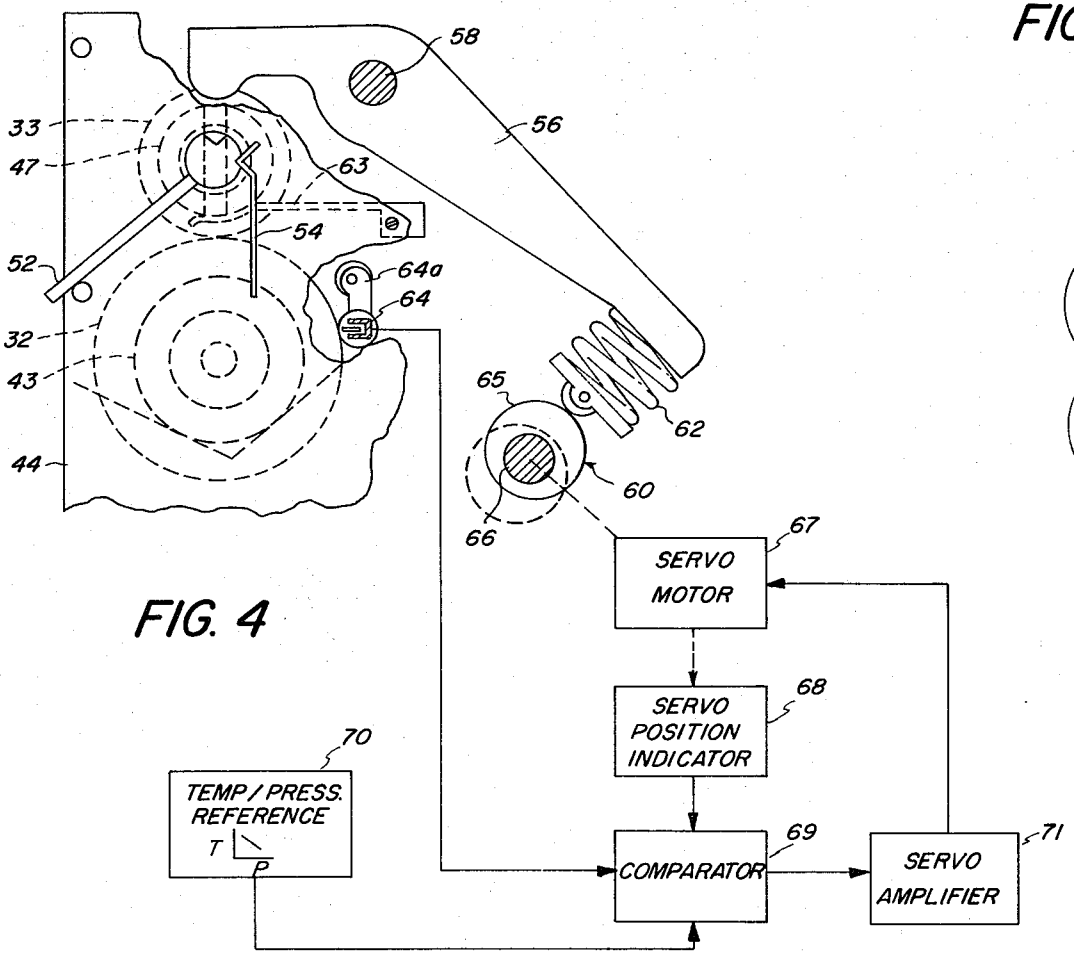
FIG. 4 is a side elevational, partially schematic view of the fusing apparatus of FIG. 2, showing the pressure varying assembly an control therefor.

Referring now more particularly to FIGS. 4 and 5, there is shown a preferred embodiment of means to vary the pressure of engagement force of the pressure rollers as a function of fuser roller temperature. As shown, fusing apparatus 25 includes pressure arms 56 which are pivotally mounted on shafts 58 and which selectively act on roller 33 through end caps 46 and bearings 45. To apply pressure to roller 33 and consequently to effect pressure engagement between rollers 33 and 32, arms 56 are rotated about the axis of shafts 58 by cam mechanism 60. Mechanism 60 includes cams 65 mounted on shaft 66 to rotate therewith. Cam 65 operates on arm 56 through spring 62. Leaf spring 63 engages end cap 46 of roller 33 and urges roller 33 out of engagement with roller 32 when the roller engagement force is removed.

The temperature at the surface of heated roller 32 is sensed by means of temperature sensor 64, such as a thermistor, positioned adjacent the roller surface. Sensor 64 is maintained a preselected optimal distance from the surface of roller 32 by a support 64*a* which rides on the ends of the roller's surface.

Shaft 66 is rotated by servo motor 67, the rotational position of which is indicated by servo motor position indicator 68. Since the amount of pressure engagement between rollers 32 and 33 is a function of the rotational position of cam 65 and servo motor 67, the rotational position of servo motor 67 will give an indication of the amount of pressure engagement between rollers 32 and 33.

The temperature of heated roller 32 as sensed by sensor 64 and the position of servo motor 67 as indicated by servo motor position indicator 68 are compared in comparator 69 with a predetermined temperature/pressure relationship reference 70. If the temperature of roller 32 has changed, a pressure change signal will be generated by servo amplifier 71 to cause motor 67 to change the position of cam 65 and consequently the pressure of engagement force of rollers 33 and 32.

FIG. 6 illustrates one relationship between fuser temperature and the pressure of engagement of the fuser rollers for a predetermined quality of fused toner image. As shown, curve X exemplifies a fuser temperature/-pressure relationship for a predetermined quality of fused toner image. In order to maintain consistant fusing quality, as the temperature of the fuser increases, the pressure of engagement of the fuser rollers should decrease. Thus, if the fuser is operating at point A on curve X at a given temperature and pressure, if the temperature of fuser 25 should drop to B, the pressure of engagement of the fuser rollers should be increased to maintain fused image quality so that the temperature/pressure combination is brought to point C on curve X. Conversely, if the fuser is operating at point C on curve X and the temperature rises to point D, then the pressure should be decreased to maintain fused image quality.

It will be understood that there may be pressure/temperature relationships other than that shown in FIG. 6 which are suitable to maintain proper fusing quality. Thus, the relationship may be nonlinear or even have a positive slope. It will also be understood that fuser 25 may include two heated rollers and that two temperature sensors may be provided to sense the temperature of each of the heated rollers. In addition, fuser 25 can include members other than rollers which are brought into pressure engagement, such as endless belts. Other means known to those skilled in the art for bringing the fuser members into pressure engagement than that shown may also be provided.

The invention has been described in detail with particular reference to preferred embodiments thereof, but it will be understood that variations and modifications can be effected within the spirit and scope of the invention.

What is claimed is:

1. In apparatus for fusing a toner image carried by a support, and including first and second members forming a nip through which a support bearing a toner image is passed, means for heating at least one of said members and means for sensing the temperature of said at least one heated member, the improvement comprising:

means for supporting said members in variable pressure engagement; and means for varying the pressure of engagement of said members while said members are engaged in response to the sensing by said sensing means of a change in temperature of said at least one heated member.

2. Apparatus for fusing a toner image carried by a support comprising:

a first member, a second member, means for heating at least one of said members, means for supporting said members in variable pressure engagement to fuse a toner image carried by a support passed between said member;

means for sensing the temperature of said at least one heated member; and means for varying the pressure of engagement of said members while said members are engaged in response to the sensing by said sensing means of a change in temperature of said at least one heated member.

3. The apparatus of claim 2 wherein said first and second members are rollers.

4. The apparatus of claim 2 wherein said heating means heats both of said members.

5. The apparatus of claim 2 wherein said pressure varying means increases the pressure engagement force of said members in response to a decrease in temperature sensed by said sensing means.

6. The apparatus of claim 2 wherein said pressure varying means decreases the pressure of engagement of said members in response to an increase in temperature sensed by said sensing means.

7. The apparatus of claim 2 wherein said means for sensing temperature continuously senses the temperature of said at least on heated member while said members are engaged and wherein said means for varying pressure varies the pressure of engagement between said members in accordance with a predetermined pressure-temperature relationship to maintain consistent fusing quality of toner images carried by successive supports.

8. In the method of fusing including the steps of applying heat and pressure to a support bearing a toner image, the improvement comprising:

sensing the temperature of the heat applied to the support; and while the pressure is applied to said support varying the pressure applied to the support in response to the sensing of a change in said temperature.

* * * * *